United States Patent [19]

Hamada et al.

[11] Patent Number: 4,801,042

[45] Date of Patent: Jan. 31, 1989

[54] INNER BAG FOR CONTAINER

[75] Inventors: Hiroshi Hamada; Takamitsu Watanabe; Mitiharu Suzuki, all of Tokyo, Japan

[73] Assignee: Kawasaki Kisen Kaisha, Hyogo, Japan

[21] Appl. No.: 141,860

[22] Filed: Jan. 11, 1988

[30] Foreign Application Priority Data

Feb. 25, 1987 [JP] Japan ..... 52-25675

[51] Int. Cl.[4] ..... B65D 90/04

[52] U.S. Cl. ..... 220/410; 220/404; 105/423; 206/204

[58] Field of Search ..... 383/22; 220/403, 404, 220/410; 410/117, 118, 68; 105/423; 206/204

[56] References Cited

U.S. PATENT DOCUMENTS

| | | | |
|---|---|---|---|
| 2,088,881 | 8/1937 | Thompson | 105/423 |
| 2,914,377 | 11/1959 | Bull | 422/8 |
| 3,578,213 | 5/1971 | Clarke et al. | 222/95 |
| 4,461,402 | 7/1984 | Fell et al. | 105/423 X |

FOREIGN PATENT DOCUMENTS

| | | |
|---|---|---|
| 0017864 | 10/1974 | Japan . |
| 0114346 | 2/1986 | Japan . |
| 0128984 | 3/1986 | Japan . |
| 0128985 | 3/1986 | Japan . |
| 0128986 | 3/1986 | Japan . |
| 0129311 | 3/1986 | Japan . |
| 0099274 | 1/1987 | Japan . |

*Primary Examiner*—Stephen Marcus
*Assistant Examiner*—Nova Stucker
*Attorney, Agent, or Firm*—Pollock, VandeSande & Priddy

[57] ABSTRACT

An inner bag for a container includes an upper surface, a bottom surface, a rear surface, side surfaces and a front surface to form a substantial hexahedron and has jointing portions for jointing the inner bag to inner walls of the container. The inner bag comprises a hygroscopic waterproof member provided on at least part of outer surfaces of the inner bag. The waterproof member absorbs water entered the container or deposited by dewing to prevent goods accommodated in the inner bag from being contaminated by the water.

6 Claims, 2 Drawing Sheets

PRIOR ART

INNER BAG FOR CONTAINER

BACKGROUND OF THE INVENTION

1. Field of the Invention

This invention relates to an inner bag for a container for use in transportation.

2. Operation of the Prior Art

Containers have been widely used for transporting goods on large scale by ships and railway trains such as corns, foods, raw materials for industries, industrial goods and other loads accommodated in the containers. If these goods are directly received in the containers, insides of the containers are likely to be contaminated by the goods or smell or odor of the goods often remains in the containers, which detrimentally affects goods received in the containers for next transportation. In order to avoid such a disadvantage, goods are often received in an inner bag located in a container for transportation without directly accommodating the goods in the container.

One example of such an inner bag hitherto used (Japanese Laid-open Patent Application No. 49-105,686) will be explained hereinafter by referring to FIG. 1.

FIG. 1 is a schematic perspective view illustrating a hitherto used inner bag for a container. In the drawing, reference numeral 8 illustrates the inner bag itself. The inner bag 8 mainly comprises an upper surface 10, a bottom surface 12, a rear surface 14, side surfaces 16 and 18 and a front surface 20 to form a substantial hexahedron. The inner bag further comprises hangers 22 and 24 and dump-up fixtures 26 for jointing the inner bag to the inside of the container.

Reference numerals 28 and 30 denote charging openings and a small discharging opening, respectively. In this illustrated example, the charging openings 28 are provided on the upper surface 10 for charging the goods, and the small discharging opening 30 is provided on the front surface 20 of the inner bag 8 for discharging the goods therefrom. Reference numerals 32 and 34 denote a screen canvas and a skirt canvas to form the front surface 20. The inner bag shown in FIG. 1 is hung and extended in the container by the hangers 22 and 24 and the dump-up fixtures 26 and thereafter goods are accommodated in the inner bag.

During transporting goods in an inner bag in a container, dew is often deposited on inner walls of the container and surfaces of the inner bag. Moreover, rain water or sea water enters the container and deposits on outer surfaces, particularly an upper surface of the inner bag like small pools or droplets and further forms a pool on a bottom surface of the container.

With inner bags hitherto used, however, when the inner bag is tilted into a dump-up position for discharging goods accommodated therein, the water flows along the outer surfaces of the inner bag or the bottom surface of the container to the discharging opening, so that goods such as barleycorns for beer or chemical medicines discharging through the opening are splashed with the water or get wet. Furthermore, water often enters the inner bag through its sewed seams to contaminate goods therein. In transporting machines or metal goods, these goods often rust by the water entered in the inner bag.

It is a principal object of the invention to provide an inner bag for a container which solves these problems in the prior art bag and which has a construction capable of preventing goods accommodated therein from being contaminated by the water produced by rain water, dewing or the like.

SUMMARY OF THE INVENTION

In order to achieve this object the inner bag for a container including an upper surface, a bottom surface, a rear surface, side surfaces and a front surface to form a substantial hexahedron and having jointing portions for jointing said inner bag to inner walls of the container a according to the invention, comprises a hygroscopic waterproof member provided on at least part of outer surfaces of the inner bag.

In a preferred embodiment of the invention, the waterproof member is made of an unwoven fabric.

Waterproof members are preferably provided on front and rear portions of the upper surface in the form of belts, and particularly the waterproof members extend from an edge between the upper surface and one side surface to an edge between the upper surface and the other side surface.

In a further embodiment of the invention, the waterproof members are further provided on front and rear portions of the bottom surface in the form of belts, and particularly the waterproof members extend from an edge between the bottom surface and one side surface to an edge between the bottom surface and the other side surface.

With the inner bag constructed as above described, the waterproof members provided on part, parts or all of the outer surfaces of the inner bag absorb the water when rain water or sea water enters the container or dew is deposited on the outer surfaces of the inner bag to prevent the water from entering the inner bag, thereby preventing goods from being contaminated by the water. The waterproof members absorb the water accumulated on the outer surfaces of the inner bag to prevent the goods from being contaminated by the water flowing along the outer surfaces of the inner bag while the goods are discharged from the inner bag in a dump-up position.

BRIEF DESCRIPTION OF THE DRAWINGS

In order that the invention may be more clearly understood, preferred embodiments will be described, by way of example, with reference to the accompanying drawings.

DETAILED DESCRIPTION OF PREFERRED EMBODIMENTS

Figure 1:
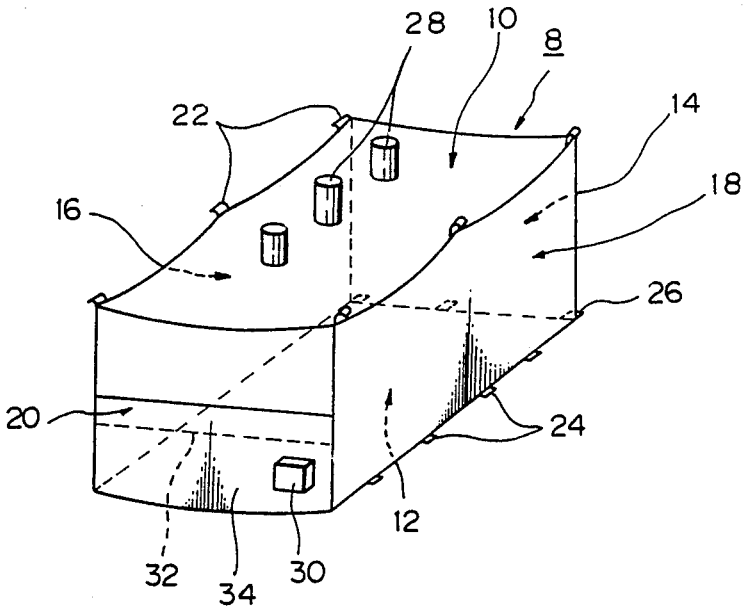
FIG. 1 is a schematic perspective view illustrating the inner bag for a container of the prior art.

The attached drawing for explaining the invention is drawn to an extent that the invention can be substantially understood and therefore shapes, dimensions and positional relations between the respective components of the invention are not limited to those shown in the drawing.

Figure 2:
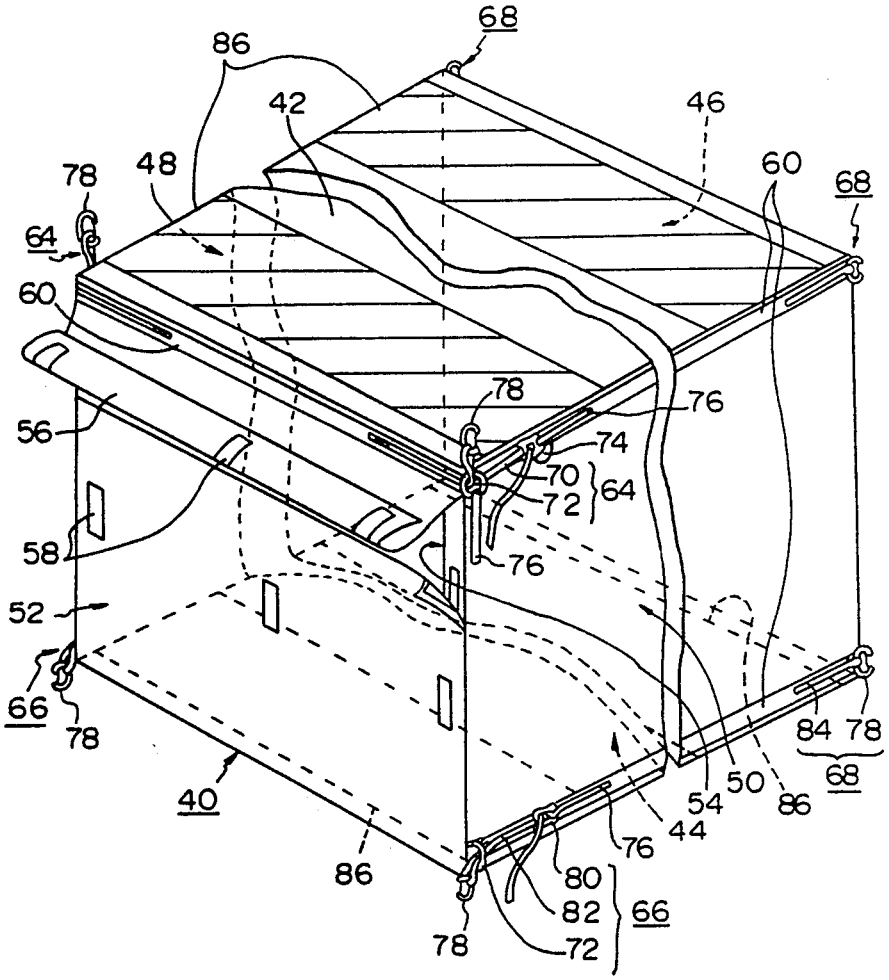
FIG. 2 is a schematic perspective view illustrating one embodiment of the inner bag for a container according to the invention.

FIG. 2 is a perspective view schematically illustrating one embodiment of the inner bag for a container according to the invention. Reference numeral 40 denotes the inner bag itself. The inner bag 40 comprises mainly an upper surface 42, a bottom surface 44, a rear surface 46, side surfaces 48 and 50 and a front surface 52 to form a substantial hexahedron.

Any constitution of the inner bag may be acceptable. In this embodiment, for example, the inner bag is provided with an opening 54 at an upper portion of the front surface 52 for charging goods and with a cover member 56 extending from a location above the opening 54 for opening and closing the opening 54. Reference numeral 58 denotes fastening members, for example, surface fasteners. In this embodiment, an extending end of the cover member 56 is anchored to a substantial center portion of the front surface 52 by means of the fastening members 58 for closing the opening 54.

In the case that the goods accommodated in the inner bag 40 are, for example, barleycorns for beer, the lower portion of the front surface 52 is formed with an opening by cutting part of the lower portion with a knife, so that the container is brought into a dump-up position to discharge the barleycorns through the opening. In discharging corns, moreover, they may be discharged through the opening 54 by means of vacuum suction means.

Belt cloths 60 are provided along edges of the inner bag in this embodiment to reinforce the inner bag 40.

Reference numerals 64, 66 and 68, illustrate jointing portions provided on the inner bag for jointing the inner bag to inner walls of the container.

In this embodiment, the jointing portions 64 are provided at two corners on the upper portion of the front surface of the inner bag. The jointing portions 68 are located at four upper and lower corners of the rear surface.

Any construction of the jointing portions 64, 66 and 68 are acceptable. In this embodiment, for example, the jointing portions 64 may be case hanging devices proposed by the applicant of this case. The jointing portion 64 comprises a belt member 70 whose one end (fixed end) is fixed to a side edge of one corner of the inner bag and the other end (free end) is anchored to a buckle 74 provided at a side edge of the other corner of the inner bag, and an annular body 72 provided at the corner. In the illustrated embodiment, the annular body 72 is provided at the corner with the aid of the belt member 76, and buckle 74 is provided at the side edge of the corner by means of the belt member 76.

Part of the belt member 70 between the fixed and free ends passes through the annular body 72 to form a partial loop. The loop is connected to an attaching portion (not shown) of an inner wall of the container by means of a C-shaped mounting ring 78.

The jointing portion 64 is able to adjust the loop into smaller sizes by pulling the free end of the belt member 70. In hanging and extending the inner bag 40 in the container, the loop of the belt member 70 is made smaller to tension the inner bag 40.

The buckle 74 in this embodiment is provided with a stopper which is inoperative, that is, not anchoring the free end of the belt member when it is pulled in a direction making the loop smaller, but is operative to anchor the free end when the belt member is subjected to a force in a direction opposite to the direction making the loop smaller. As a result, the loop in the smaller size is held in its size by the buckle 74 with the stopper, so that the inner bag is maintained under the tensioned condition.

Moreover, the jointing portion 66 comprises an annular body 72 provided at the corner of the inner bag 40 and a belt member 82 whose one end (fixed end) is fixed to a side edge of a corner of the inner bag and the other end (free end) is anchored by a buckle 80 provided in the proximity of the side edge to which the one end is fixed. In this embodiment, the buckle 80 is provided at the side edge of the corner of the inner bag with the aid of a belt member 76, and the annular body 72 is arranged at the side edge of the corner with the aid of a belt cloth 60.

In the jointing portion 66, part of the belt member 82 passes through the annular body 72 to form a loop in the same manner as in the jointing portion 64. The loop is connected to an attaching portion of an inner wall of the container with the aid of a mounting ring 78 to enable the inner bag 40 to be tensioned and extended.

Moreover, the loops of the belt members 70 and 82 may be directly connected to the attaching portions of the inner walls of the container.

The jointing portion 68 in this embodiment comprises a belt member 84 fixed to a side edge of a corner of the inner bag 40 and a mounting ring 78 fixed to the belt member 84. In hanging and extending the inner bag 40, the mounting ring 78 of the jointing portion 68 is connected to an attaching portion on an inner wall of the container.

In FIG. 2, moreover, reference numeral 86 denotes hygroscopic waterproof members provided on part or parts or all over the outer surfaces of the inner bag 40.

In this embodiment, the waterproof members 86 are made of an unwoven fabric and partially provided at suitable locations of front and rear portions of the upper surface 42 in the form of belts. The waterproof members 86 provided on the upper surfaces are indicated by hanging in the drawing. The respective waterproof members 86 are preferably extended on the upper surface 42 from the edge between the upper surface and the one side surface to the edge between the upper surface and the other side surface. As a result, the water is absorbed by the waterproof members 86 to prevent the water from staying on slacks of the upper surface of the inner bag hung and extended in the container and therefore to prevent the water from entering the inner bag 40 through the upper surface 42 or to prevent the water on the upper surface 42 from flowing into the goods along the inner bag 40 while the goods are discharged from the inner bag in the dump-up position.

More preferably, waterproof members 86 are partially provided at suitable locations of front and rear portions of the bottom surface 44. In this case, the waterproof members 86 are preferably extended on the bottom surface 44 from the edge between the lower surface and the one side surface to the edge between the lower surface and the other side surface. As a result, the water is absorbed by the waterproof members 86 to prevent the water from accumulating at the bottom surface and therefore to prevent the water from entering the inner bag 40 through the bottom surface 44 or to prevent the water on the bottom surface from flowing into the goods along the inner bag 40 while the goods are discharged from the inner bag in the dump-up position.

In designing the waterproof members 86, sizes, shapes, areas and other designing conditions may be suitably selected at will.

This invention is not limited to the embodiment as above described and may be modified in various manners depending upon design conditions.

For example, the waterproof members may be made from any materials other than the unwoven fabric, for example, various kinds of papers, woven fabrics, spongy foam materials and the like. Moreover, the waterproof material may consist of a bag member and a hygroscopic solid, powdery or granular material accommodated in the bag member. In this case, part of the bag member may be made of a water permeable material and the other part may be made of a waterproof material. Furthermore, all the bag members may be made of a waterproof material and the bag member may be formed with apertures or openings having sizes permitting water to enter therethrough but not permitting the hygroscopic material accommodated therein to go out of the bag member. Moreover, the waterproof member may be made of a composite member consisting of a member having a waterproof property or made waterproof, and a hygroscopic member.

Moreover, the waterproof members may be provided at any suitable locations on the inner bag according to requirements for designing. For example, the waterproof members may be distributed all over the upper surface of the inner bag in any preferable positional relations. The waterproof members may cover all the upper surface of the inner bag. The waterproof members may be provided on the side surfaces, the front surface or the rear surface in addition to the upper and bottom surfaces. Moreover, the waterproof members may be provided on the inner bag so as to completely cover all outer surfaces of the inner bag.

Of course, that the jointing portions, charging openings or discharging opening may be provided at any suitable locations, and any constitutions of the jointing portions, charging openings or discharging opening may be accepted.

This invention may be applied to various kinds of hitherto proposed inner bags of containers. The waterproof members may be provided on part, parts or all of the outer surfaces of the inner bag hitherto proposed.

As can be seen from the above explanation, according to the present invention the waterproof members provided on part, parts or all of the outer surfaces of the inner bag absorb the water when rain water or sea water enters the container or dew is deposited on the outer surfaces of the inner bag. This absorption of water by the waterproof members prevents the water from entering the inner bag through its upper or bottom surfaces and hence to prevent the goods accumulated in the bag from being contaminated by the entered water.

In discharging the goods from the inner bag in a dump-up position, the waterproof members absorb the water accumulated on the upper or lower surface of the inner bag or deposited water by dewing during the water flowing along outer surfaces of the inner bag, thereby preventing the goods in the inner bag from being contaminated by the water.

It is further understood by those skilled in the art that the foregoing description is that of preferred embodiments of the disclosed bags and that various changes and modifications may be made in the invention without departing from the spirit and scope thereof.

What is claimed is:

1. An inner bag for a container including an upper surface, a bottom surface, a rear surface, side surfaces and a front surface to form a substantial hexahedron and having jointing portions for jointing said inner bag to inner walls of the container, said inner bag comprising waterproof means provided on front and rear portions of the upper surface in the form of belts.

2. An inner bag as set forth in claim 1, wherein the waterproof means is made of an unwoven fabric.

3. An inner bag as set forth in claim 1 wherein said waterproof means extend from an edge between the upper surface and one side surface to an edge between the upper surface and the other side surface.

4. An inner bag for a container including an upper surface, a bottom surface, a rear surface, side surfaces and a front surface to form a substantial hexahedron and having jointing portions for jointing said inner bag to inner walls of the container, said inner bag comprising waterproof means provided on front and rear portions of the bottom surface in the form of belts.

5. An inner bag as set forth in claim 4, wherein said waterproof means extend from an edge between the bottom surface and one side surface to an edge between the bottom surface and the other side surface.

6. An inner bag as set forth in claim 4, wherein the waterproof means is made of an unwoven fabric.

* * * * *

UNITED STATES PATENT AND TRADEMARK OFFICE

CERTIFICATE OF CORRECTION

PATENT NO. : 4,801,042

DATED : January 31, 1989

INVENTOR(S) : Hiroshi Hamada, et al.

It is certified that error appears in the above-identified patent and that said Letters Patent is hereby corrected as shown below:

Column 2, line 9, after "container" insert a --,--.

Column 2, line 10, change "a according" to --according--.

Column 5, line 27, delete "that".

Signed and Sealed this

Eighth Day of August, 1989

*Attest:*

*Attesting Officer*

DONALD J. QUIGG

*Commissioner of Patents and Trademarks*